US011724915B2

(12) United States Patent
Chen

(10) Patent No.: US 11,724,915 B2
(45) Date of Patent: Aug. 15, 2023

(54) TOP EXTENSIBLE SECTION AND THE OPERATION METHOD THEREOF, ELEVATOR CAR ASSEMBLY AND ELEVATOR SYSTEM

(71) Applicant: Otis Elevator Company, Farmington, CT (US)

(72) Inventor: Zhuo Chen, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/385,237

(22) Filed: Jul. 26, 2021

(65) Prior Publication Data

US 2022/0048739 A1 Feb. 17, 2022

(30) Foreign Application Priority Data

Aug. 13, 2020 (CN) ..... 202010812848.X

(51) Int. Cl.
*B66B 11/02* (2006.01)
*B66B 5/00* (2006.01)

(52) U.S. Cl.
CPC ..... *B66B 11/0226* (2013.01); *B66B 5/0081* (2013.01)

(58) Field of Classification Search
CPC ..... B66B 11/0226; B66B 5/0081; B66B 11/0246
See application file for complete search history.

(56) References Cited

U.S. PATENT DOCUMENTS 6,543,584 B1 * 4/2003 Miyakoshi ..... B66B 5/0081 187/401
10,836,605 B2 * 11/2020 Roussel ..... B66B 5/0081
11,174,124 B2 * 11/2021 Schuler ..... B66B 11/0226
2005/0230194 A1 * 10/2005 Nakamura ..... B66B 5/0081 187/401
2006/0289244 A1 * 12/2006 Sittler ..... B66B 11/0246 187/401
2007/0056809 A1 * 3/2007 Fernandes ..... B66B 11/0246 187/401
2007/0056810 A1 * 3/2007 Fernandes ..... B66B 11/0246 187/401

(Continued)

FOREIGN PATENT DOCUMENTS

CN 109963803 B * 3/2021 ..... B66B 5/0081
JP 05246662 A * 9/1993

(Continued)

*Primary Examiner* — Michael A Riegelman
(74) *Attorney, Agent, or Firm* — Cantor Colburn LLP

(57) ABSTRACT

A top extensible section and an operating method thereof, an elevator car assembly, and an elevator system. The top extensible section is installed above a top plate of the elevator car when in use. The top extensible section includes a top wall and a plurality of side walls, and has an unfolded state and a folded state; in the unfolded state, the top wall and the plurality of side walls of the top extensible section define an expansion space which communicates with an inner space of the elevator car to provide an additional top space; and in the folded state, the top wall of the top extensible section is lowered to be substantially flush with the top plate of the elevator car, and the plurality of side walls are folded to provide an operating space on the plurality of side walls.

11 Claims, 5 Drawing Sheets

(56) References Cited

U.S. PATENT DOCUMENTS

| | | | | |
|---|---|---|---|---|
| 2008/0217113 | A1* | 9/2008 | Bonatre | B66B 5/0081 187/401 |
| 2018/0086604 | A1* | 3/2018 | Fonteneau | B66B 5/0087 |
| 2019/0256323 | A1* | 8/2019 | Schuler | B66B 5/0081 |
| 2021/0155458 | A1* | 5/2021 | Montigny | B66B 11/0246 |
| 2021/0354955 | A1* | 11/2021 | Haapaniemi | B66B 5/0087 |
| 2022/0048739 | A1* | 2/2022 | Chen | B66B 11/0226 |

FOREIGN PATENT DOCUMENTS

| | | | | |
|---|---|---|---|---|
| JP | H06278973 | A | * | 10/1994 |
| JP | 2007001698 | A | * | 1/2007 |
| JP | 2015027898 | A | * | 2/2015 |

* cited by examiner

TOP EXTENSIBLE SECTION AND THE OPERATION METHOD THEREOF, ELEVATOR CAR ASSEMBLY AND ELEVATOR SYSTEM

FOREIGN PRIORITY

This application claims priority to China Patent Application No. 202010812848.X, filed Aug. 13, 2020, and all the benefits accruing therefrom under 35 U.S.C. § 119, the contents of which in its entirety are herein incorporated by reference.

TECHNICAL FIELD

The present disclosure relates to the field of elevators, and more specifically, the present disclosure relates to a foldable top extensible section (doghouse) for an elevator car and an operating method thereof.

BACKGROUND

The elevator car is limited by its vertical height when transporting elongated objects. In order to carry elongated objects, some elevator cars are provided with a top extensible section.

SUMMARY

An object of the present disclosure is to solve or at least alleviate problems existing in the related art.

In an aspect, a top extensible section for an elevator car is provided, which is installed above a top plate of the elevator car when in use, wherein the top extensible section includes a top wall and a plurality of side walls, and has an unfolded state and a folded state; in the unfolded state, the top wall and the plurality of side walls of the top extensible section define an expansion space which communicates with an inner space of the elevator car to provide an additional top space; and in the folded state, the top wall of the top extensible section is lowered to be substantially flush with the top plate of the elevator car, and the plurality of side walls are folded to provide an operating space on the plurality of side walls.

Optionally, in the top extensible section, the top extensible section further includes a fence that can be raised and lowered; when the top extensible section is in the folded state, the fence can be lowered to provide protection for the operating space on the plurality of side walls, and when the elevator car is in the unfolded state, the fence is raised above the top wall of the top extensible section.

Optionally, in the top extensible section, the top wall is suspended below the fence by a rope, and the rope can be driven by a motor for retracting and releasing the rope, so that the top wall is raised or lowered.

Optionally, in the top extensible section, at least a part of the plurality of side walls includes an upper portion and a lower portion, wherein the lower portion is connected to a top portion of the elevator car by a hinge and the upper portion is connected to the lower portion by a hinge to allow at least a part of the plurality of side walls to be folded in half along a folding line defined by the hinges.

Optionally, in the top extensible section, at least a part of the plurality of side walls includes an electromagnetic connector connected between the upper portion and the lower portion, so that the electromagnetic connector keeps the upper portion and the lower portion stable in the unfolded state.

Optionally, in the top extensible section, electromagnetic connectors are provided between the plurality of side walls and the top wall.

Optionally, in the top extensible section, the top extensible section is substantially cubic in the unfolded state, and the plurality of side walls include a front wall, a rear wall, a left wall and a right wall.

Optionally, in the top extensible section, the front wall, the rear wall, the left wall and the right wall are each composed of an upper portion and a lower portion connected by a hinge; in the folded state, the left wall and the right wall are each folded in half and placed above the top wall, and the front wall and the rear wall are each folded in half and placed above the left wall and the right wall.

Optionally, in the top extensible section, the top extensible section is located on a rear side of a guide shoe on the top portion of the elevator car.

In another aspect, an elevator car assembly is provided, which includes: an elevator car including a top plate; and the top extensible section according to various embodiments, which is located above the top plate of the elevator car.

In another aspect, an elevator system is provided, which includes the elevator car according to various embodiments.

In another aspect, an operating method of a top extensible section for an elevator car is provided, wherein the top extensible section is located above a top plate of the elevator car and includes a top wall and a plurality of side walls, and the method includes folding the top extensible section through the following steps: lowering the top wall to a height substantially flush with the top plate of the elevator car; folding the plurality of side walls; and lowering a fence to provide protection for an operating space on the plurality of side walls.

Optionally, the method further includes: suspending the top wall from the fence by a rope, and lowering the top wall to a height substantially flush with the top plate of the elevator car by releasing the rope.

Optionally, the method further includes: connecting the plurality of side walls and the top wall through electromagnetic connectors, and unlocking the electromagnetic connectors through a control switch to allow the top wall to be lowered; and/or connecting an upper portion and a lower portion of at least a part of the plurality of side walls through an electromagnetic connector, and unlocking the electromagnetic connector through a control switch to allow at least a part of the plurality of side walls to be folded in half.

Optionally, the plurality of side walls include a front wall, a rear wall, a left wall, and a right wall, and the method further includes: folding the left wall and the right wall in half and placing them above the top wall; and folding the front wall and the rear wall in half and placing them above the left wall and the right wall.

The elevator car according to the embodiment of the present disclosure is provided with a foldable top extensible section.

BRIEF DESCRIPTION OF THE DRAWINGS

The contents of the present disclosure will become easier to understand with reference to the accompanying drawings. It can be easily understood by those skilled in the art that the drawings are merely used for illustration, and are not intended to limit the scope of protection of the present disclosure. In addition, like parts are denoted by like numerals in the drawings, wherein.

DETAILED DESCRIPTION

Figure 1:
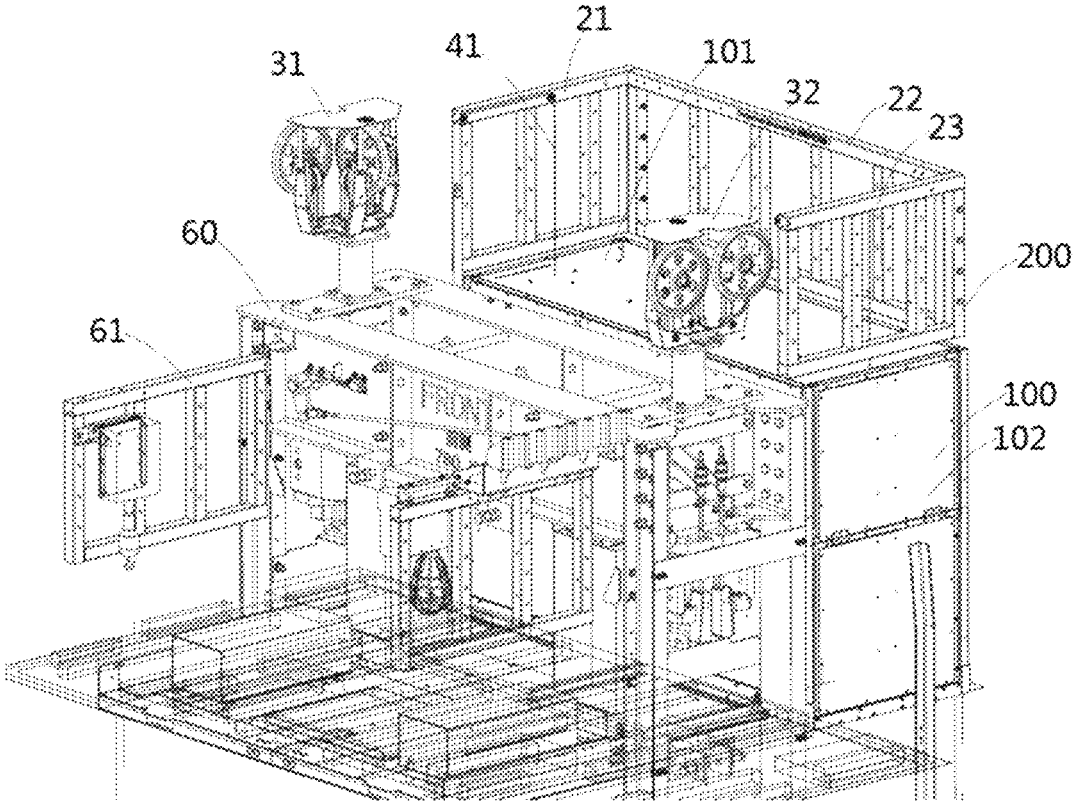
FIG. 1 shows a view showing a top portion of an elevator car assembly according to an embodiment of the present disclosure, wherein a top extensible section is in an unfolded state.

Referring now to FIG. 1, an elevator car assembly according to an embodiment of the present disclosure will be described. FIG. 1 is a view showing a top portion of the elevator car assembly. The elevator car assembly includes an elevator car, and the elevator car includes a top plate. Above the top plate of the elevator car, a top bracket 60, a front-side fence 61 on a front side of the top bracket 60, guide shoes 31, 32 above the top bracket 60, and a top extensible section 100 according to the embodiment of the present disclosure located on a rear side of the top bracket 60 are disposed. The top extensible section 100 is installed on a top portion of the elevator car when in use. A fence 200 is disposed above the top extensible section 100, or it may be called a rear-side fence. Herein, the front side refers to a side close to a car door, and the back side refers to a side away from the car door. Although not shown, the top portion of the car may further include a distribution box, connection wires, traction ropes and other devices. When the car is running, the guide shoes 31 and 32 on the top bracket 60 are engaged with guide rail to guide an up-and-down movement of the car.

As shown in FIG. 1, the top extensible section 100 is in an unfolded state. In this situation, an expansion space of the top extensible section 100 communicates with an inner space of the elevator car to provide an additional top space, such as for transporting objects having an over-standard height. Although the top extensible section 100 provides the additional top space inside the elevator car, its existence affects a maintenance operation of the top portion of the elevator car. For example, it is impossible for the operator to stand at rear side of the top portion of the elevator car for maintenance. On the other hand, the top extensible section 100 protruding from the top plate of the elevator car places additional requirements on the height of hoistway. Therefore, the embodiment of the present disclosure provides a foldable top extensible section. Specifically, the top extensible section 100 for an elevator car of the present disclosure can be switched from the unfolded state shown in FIG. 1 to a folded state shown in FIG. 4. In the folded state, a top wall 101 of the top extensible section is lowered to be substantially flush with the top plate of the elevator car, and a plurality of side walls of the top extensible section are folded to provide an operating space on the plurality of side walls on the top portion of the car. The operator can stand on the operating space for maintenance operations.

In the illustrated embodiment, the top extensible section 100 may include the top wall 101 and the plurality of side walls 102, which define an inner space together. For example, in the embodiment shown in the figure, the top extensible section 100 is substantially cubic in the unfolded state, and has four side walls 102, 103, 104 and 105 (see FIG. 3). The top wall and the four side walls jointly define an inner expansion space of the cube, which communicates with the inner space of the elevator car. The fence 200 may include side fences 21 and 23 and a rear fence 22.

Figure 2:
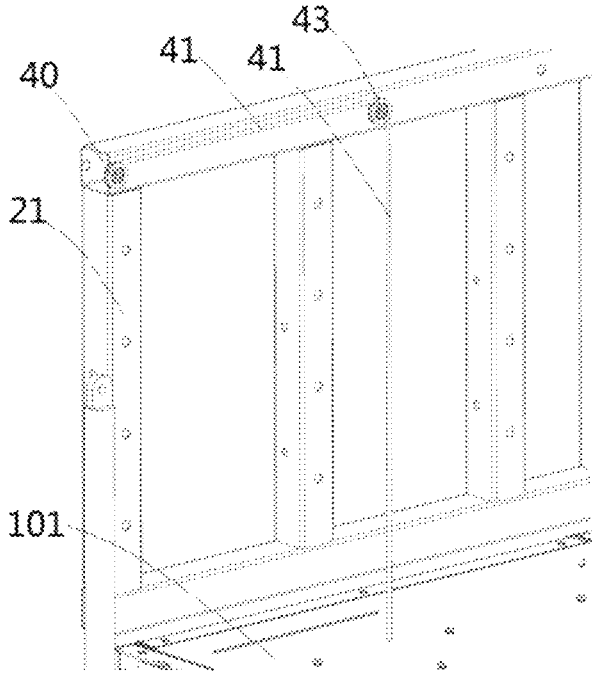
FIG. 2 shows a partially enlarged view of a fence in FIG. 1.

In some embodiments, the top wall 101 is suspended below the fence by a rope 41, for example, below the two side fences 21 and 23. Specifically, referring to FIG. 2, the top wall 101 is telescopically suspended from the fence 21 by means of the rope 41, several rollers 43 and a motor 40. By means of the rotation of the motor 40, the top wall 101 can be raised or lowered through the retracting and releasing of the rope 41. For example, it is lowered from the position shown in FIG. 1 to a position flush with the top plate of the elevator car, or it is pulled from the position flush with the top plate of the elevator car to the position shown in FIG. 1. It should be understood that the top wall 101 is supported when it is flush with the top plate of the elevator car, for example, supported by a beam below it.

Figure 3:
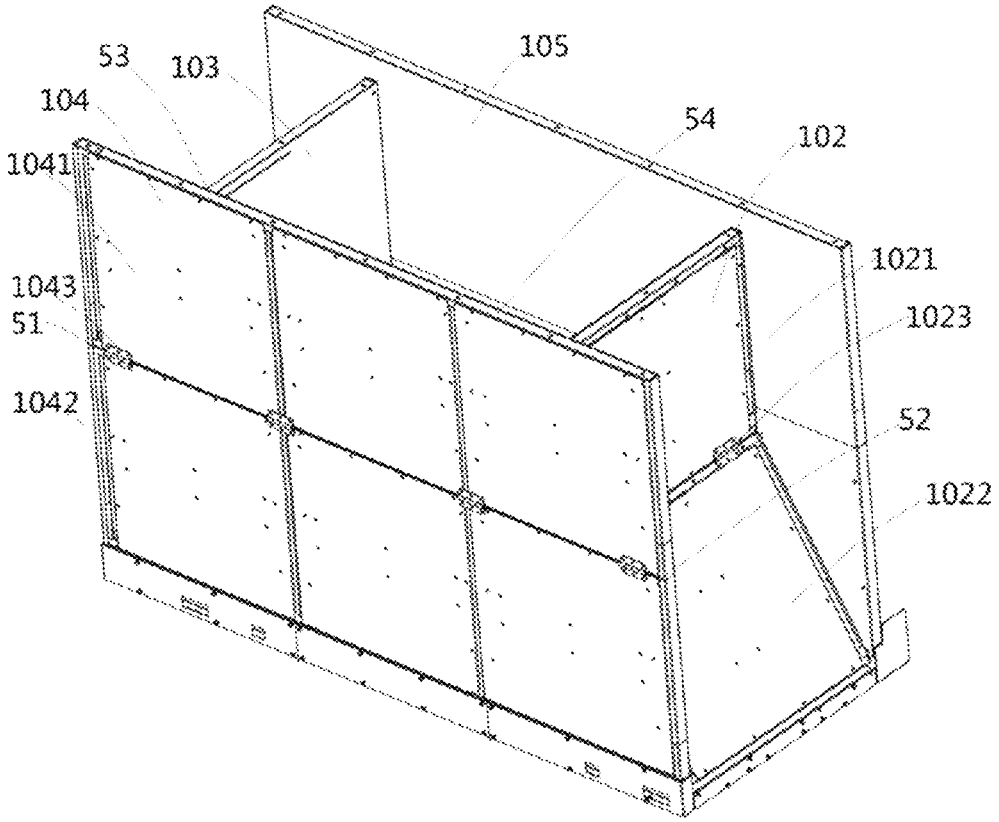
FIG. 3 is a schematic view showing a folding process of the top extensible section in FIG. 1.

Next, referring to FIG. 3, a folding process of the plurality of side walls after the top wall is lowered will be described. In some embodiments, the plurality of side walls may be directly folded onto the top wall 101 as a whole. In some embodiments, the plurality of side walls may include a front wall 104, a rear wall 105, a left wall 103 and a right wall 102, and they define the top expansion space of the cube together. In some embodiments, at least a part of the plurality of side walls is composed of an upper portion and a lower portion connected by a hinge, so as to allow at least a part of the plurality of side walls to be folded in half along a folding line defined by the hinge. For example, in the illustrated embodiment, the front wall 104 includes an upper front wall 1041 and a lower front wall 1042 connected by a hinge 1043. The lower front wall 1042 is further connected to the top portion of the car by a hinge. The rear wall 105 may have the same or similar construction. In addition, the right wall 102 has an upper right wall 1021 and a lower right wall 1022 connected by a hinge 1023. The lower right wall 1022 is further connected to the top portion of the car by a hinge. The left wall 103 may have the same or similar construction. In some embodiments, the front wall 104 and the rear wall 105 may each be composed of an upper portion and a lower portion, and the left wall 103 and the right wall 102 may be folded onto the top wall 101 as a whole. In the illustrated embodiment, the left wall 103 and the right wall 102 are first folded in half along the hinges and placed above the top wall 101, and then the front wall 104 and the rear wall 105 are folded in half along the hinges and placed above the left wall 103 and the right wall 102. In other embodiments, the front wall 104 and the rear wall 105 may be folded first, and then the left wall 103 and the right wall 102 are folded. It should be understood that if the plurality of side walls have a vertical relationship after folding, they should have different height positions after folding to ensure that each side wall remains horizontal and well supported after folding.

In some embodiments, at least a part of the plurality of side walls includes an electromagnetic connector, such as an electromagnetic plug, connected between the upper portion and the lower portion, so as to maintain the stability of the plurality of side walls in the unfolded state. For example, taking the front wall 104 as an example, it may include electromagnetic connectors at positions 51 and 52 at both ends of the folding line defined by the hinges. The electromagnetic connectors guarantee that the upper and lower portions 1041, 1042 of the front wall 104 cannot be folded relative to each other in a normal state, and are disengaged after being energized, so that the relative folding of the upper and lower portions 1041, 1042 is allowed. Other side walls may have similar arrangements. In some embodiments, electromagnetic connectors are disposed between a plurality of side walls and the top wall. For example, taking the front wall 104 as an example, electromagnetic connectors that are connected to the top wall may be provided at the top portion of the front wall 104, such as at middle positions 53, 54 of the top portion. The electromagnetic connectors guarantee the connection between the top portion of the front wall 104 and the top wall 101 in a normal state so that the top wall 101 is supported, and the electromagnetic connectors are disengaged after being energized, thus allowing the top wall 101 to be lowered. In some embodiments, electromagnetic connectors are provided between a plurality of side walls and the top portion of the car. In some embodiments, the electromagnetic connectors can be powered by a distribution box on the top portion of the car.

Figure 4:
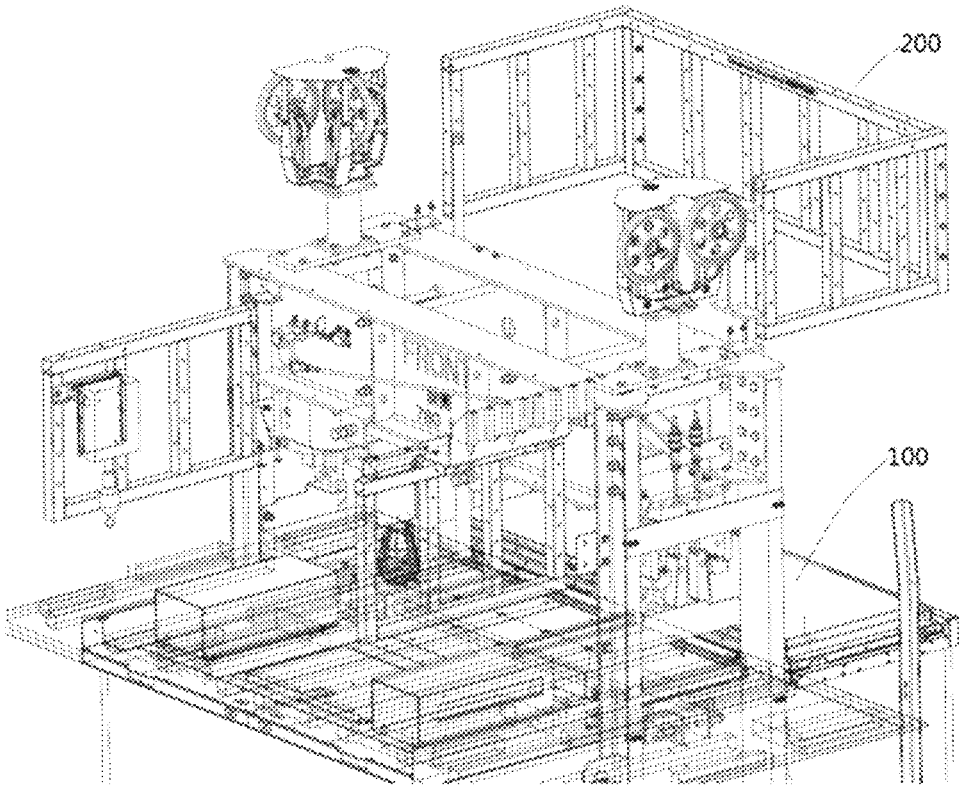
FIG. 4 shows a view showing the top portion of the elevator car assembly according to the embodiment of the present disclosure, wherein the top extensible section is in a folded state.
Figure 5:
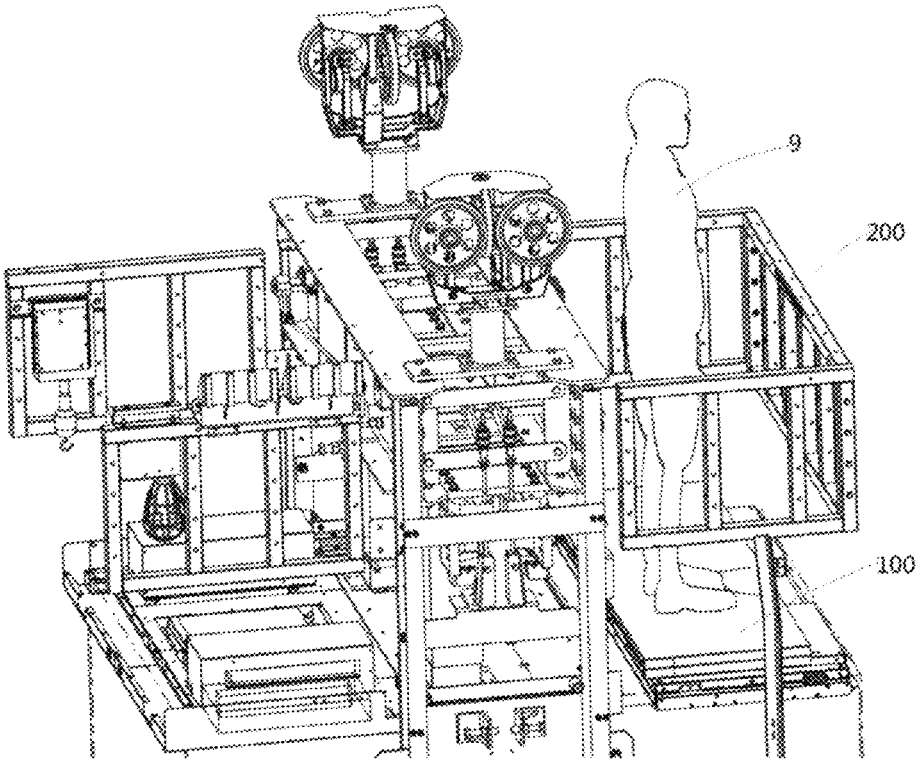
FIG. 5 shows a schematic view of a top portion of the elevator car assembly of FIG. 4 when the fence is being lowered with an operator.

Next, referring to FIG. 4, the top extensible section 100 is already in the folded state. In this state, the fence 200 can be lowered to provide protection for the operating space on the plurality of side walls. For example, as shown in FIG. 5, the operator 9 is standing on the plurality of folded side walls and is protected by the fence 200. The operator 9 can, for example, enter the top portion of the elevator car from a hall door of a higher floor next to the floor at which the elevator car is stopped, and cross the top bracket 60 to reach the rear side of the guide rail for maintenance operations.

According to another aspect of the present disclosure, an elevator car assembly is provided, which includes: an elevator car including a top plate; and the top extensible section according to various embodiments, which is located above the top plate of the elevator car.

According to another aspect of the present disclosure, an elevator system is provided, which includes the elevator car assembly according to various embodiments.

According to another aspect of the present disclosure, an operating method of a top extensible section for an elevator car is provided, which includes: lowering the top wall to a height substantially flush with the top plate of the elevator car; folding the plurality of side walls; and lowering a fence to provide protection for an operating space on the plurality of side walls.

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. Therefore, it should be understood that these modifications or changes should be included within the scope of protection of the present disclosure.

What is claimed is:

1. A top extensible section for an elevator car, which is installed above a top plate of the elevator car when in use, wherein the top extensible section comprises a top wall and a plurality of side walls, and has an unfolded state and a folded state; in the unfolded state, the top wall and the plurality of side walls of the top extensible section define an expansion space which communicates with an inner space of the elevator car to provide an additional top space; and in the folded state, the top wall of the top extensible section is lowered to be substantially flush with the top plate of the elevator car, and the plurality of side walls are folded on top of the top plate to provide an operating space including the top plate and the plurality of side walls, the operating space configured to support an operator standing on the operating space.

2. The top extensible section according to claim 1, wherein the top extensible section further comprises a fence that can be raised and lowered; when the top extensible section is in the folded state, the fence can be lowered to provide protection for the operating space on the plurality of side walls, and when the elevator car is in the unfolded state, the fence is raised above the top wall of the top extensible section.

3. The top extensible section according to claim 1, wherein the top wall is suspended below the fence by a rope, and the rope can be driven by a motor for retracting and releasing the rope, so that the top wall is raised or lowered.

4. The top extensible section according to claim 1, wherein at least a part of the plurality of side walls comprises an upper portion and a lower portion, the lower portion is connected to a top portion of the elevator car by a hinge and the upper portion is connected to the lower portion by a hinge to allow at least a part of the plurality of side walls to be folded in half along a folding line defined by the hinges.

5. The top extensible section according to claim 4, wherein at least a part of the plurality of side walls comprises an electromagnetic connector connected between the upper portion and the lower portion, so that the electromagnetic connector keeps the upper portion and the lower portion stable in the unfolded state.

6. The top extensible section according to claim 1, wherein electromagnetic connectors are provided between the plurality of side walls and the top wall.

7. The top extensible section according to claim 1, wherein the top extensible section is substantially cubic in the unfolded state, and the plurality of side walls comprises a front wall, a rear wall, a left wall and a right wall.

8. The top extensible section according to claim 7, wherein the front wall, the rear wall, the left wall and the right wall are each composed of an upper portion and a lower portion connected by a hinge; in the folded state, the left wall and the right wall are each folded in half and placed above the top wall, and the front wall and the rear wall are each folded in half and placed above the left wall and the right wall.

9. The top extensible section according to claim 1, wherein the top extensible section is located on a rear side of a guide shoe on the top portion of the elevator car.

10. An elevator car assembly, comprising:

an elevator car comprising a top plate; and the top extensible section according to claim 1, which is located above the top plate of the elevator car.

11. An elevator system, comprising the elevator car assembly according to claim 10.

* * * * *